US005254974A

United States Patent [19]

Rebers et al.

[11] Patent Number: 5,254,974

[45] Date of Patent: Oct. 19, 1993

[54] DEACTIVATING DEVICE

[75] Inventors: Paulus Rebers, Groenlo; Tallienco W. H. Fockens, Eibergen, both of Netherlands

[73] Assignee: N.V. Nederlandsche Apparatenfabriek Nedap, De Groenlo, Netherlands

[21] Appl. No.: 766,922

[22] Filed: Sep. 30, 1991

[30] Foreign Application Priority Data

Sep. 28, 1990 [NL] Netherlands ..... 9002120

[51] Int. Cl.[5] ..... G08B 13/14

[52] U.S. Cl. ..... 340/572; 340/551

[58] Field of Search ..... 340/572, 551, 825.63; 343/893-894, 866; 335/284; 361/113

[56] References Cited

U.S. PATENT DOCUMENTS

| | | | |
|---|---|---|---|
| 4,498,076 | 2/1985 | Lichtblau | 340/572 |
| 4,567,473 | 1/1986 | Lichtblau | 340/572 |
| 4,728,938 | 3/1988 | Kaltner | 340/572 |
| 4,906,974 | 3/1990 | Rehder | 340/551 |
| 5,008,649 | 4/1991 | Klein | 340/572 |
| 5,153,562 | 10/1992 | van Breemen | 340/572 |

FOREIGN PATENT DOCUMENTS 0371562 6/1990 European Pat. Off. .

9000186 9/1990 Netherlands .

*Primary Examiner*—Thomas Mullen

*Attorney, Agent, or Firm*—Jacobson, Price, Holman & Stern

[57] ABSTRACT

This invention relates to a deactivating device for deactivating shoplifting detection labels of an electronic shoplifting detection system. These labels comprise a resonant circuit with a coil and a capacitor and the deactivating device comprises an antenna circuit comprising an antenna coil tuned with at least one capacitor to the resonant frequency of the resonant circuit. By means of this arrangement, sufficient energy can be induced in a resonant circuit of a label to effect electrical breakdown in the capacitor thereof. According to the invention, the antenna coil of the deactivating device is coupled, on the one hand, to a supply source and, on the other, to earth via a switch. Circuitry is provided for supplying at intervals control pulses to the switch in order to bring the switch into the conductive state. The duration of each control pulse is chosen such that at the end of a control pulse, when the switch returns to the blocking state, the energy necessary for deactivation is stored as magnetic energy in the antenna coil. This energy is subsequently converted into an electromagnetic oscillation when the switch is in the blocking state.

22 Claims, 5 Drawing Sheets

DEACTIVATING DEVICE

BACKGROUND OF THE INVENTION

This invention relates to a deactivating device for deactivating shoplifting detection labels of an electronic shoplifting detection system, which labels comprise a resonant circuit with a coil and a capacitor, said deactivating device comprising an antenna circuit comprising an antenna coil tuned with at least one capacitor to the resonant frequency of the resonant circuit, by means of which sufficient energy can be induced in a resonant circuit of a label to effect electrical breakdown in the capacitor thereof.

An electronic shoplifting detection system consists of a plurality of components, viz.:

1. labels, which are attached to the articles to be protected;
2. detection pillars, which are arranged at the exit of a shop and serve to detect the passing labels;
3. a packaging lable detector, which serves to detect labels to be removed when the articles are purchased.

Besides labels which are removed when the articles are purchased, there are labels such as the so called adhesive labels, which are not removed, but must be deactivated, i.e. rendered inactive as a detection label. Such an adhesive label consists of insulating substrate with a track pattern of conducting material provided thereon. This track pattern forms a coil and a capacitor, together forming a resonant circuit. The resonance effect is used to detect the presence of the label. An adhesive label can be deactivated by preventing the resonance. In practice, to that end an electrical breakdown is effected in the dielectric between the capacitor plates, whereby, as a result of electric energy stored in the capacitor, a strong heating occurs very locally, so that a hole is formed in the dielectric material between the capacitor plates, and some conductor material evaporates which precipitates again on the edges of the hole in the dielectric. Thus, a conductive connection is formed between the two capacitor plates, whereby the capacitor is effectively short circuited and the resonance effect disappears. In order to reduce the energy necessary for deactivation, in some manner or other a weak spot is provided in the capacitor during manufacture of the adhesive labels, so that the voltage across the capacitor necessary for breakdown is of the order of 20 V, for instance.

A so-called deactivator is the device which must supply the energy for deactivation of an adhesive label. It is useful to combine a deactivator with a packaging table detector because after the deactivation operation it must be verified that the label has really been deactivated. This function is already provided for by existing packaging table detectors. U.S. Pat. No. 4,498,076 discloses such a deactivator. Further, an activator is disclosed in applicant's Dutch patent application NL 9000186 corresponding to U.S. patent application Ser. No. 07/645,886, filed Jan. 25, 1991, now U.S. Pat. No. 5,153,562. After the resonant frequency of the label to be deactivated has been measured, this high-frequency deactivator momentarily generates a strong high-frequency carrier wave having a frequency which is equal to that resonant frequency. This deactivator consists in principle of an oscillator, which generates a carrier wave of the desired frequency, and a power amplifier which is so dimensioned that enough power is generated to enable deactivation of even the most insensitive label types, i.e. those with the highest breakdown voltage, at a sufficiently great distance. Although this operative principle is technically satisfactory, the complex composition of this deactivator can sometimes be objectionable. Particularly in applications where adhesive labels of good deactivation sensitivity are used and deactivation from great distances is not required, there is a need for a more economical solution. This is particularly relevant if a deactivation function is to be added to existing packaging table detection devices.

SUMMARY OF THE INVENTION

It is one object of the invention to provide a solution for the situation described above. The present invention relates to a deactivating device for deactivating shoplifting labels of simple and economical construction.

The present invention will now be further described with reference to the accompanying drawings of one example.

BRIEF DESCRIPTION OF THE DRAWINGS

FIGS. *2a–2c*, 3, and 4 schematically show voltage and current forms such as may occur in operation in a deactivator according to FIG. 1.

DETAILED DESCRIPTION OF THE DRAWINGS

Figure 1:
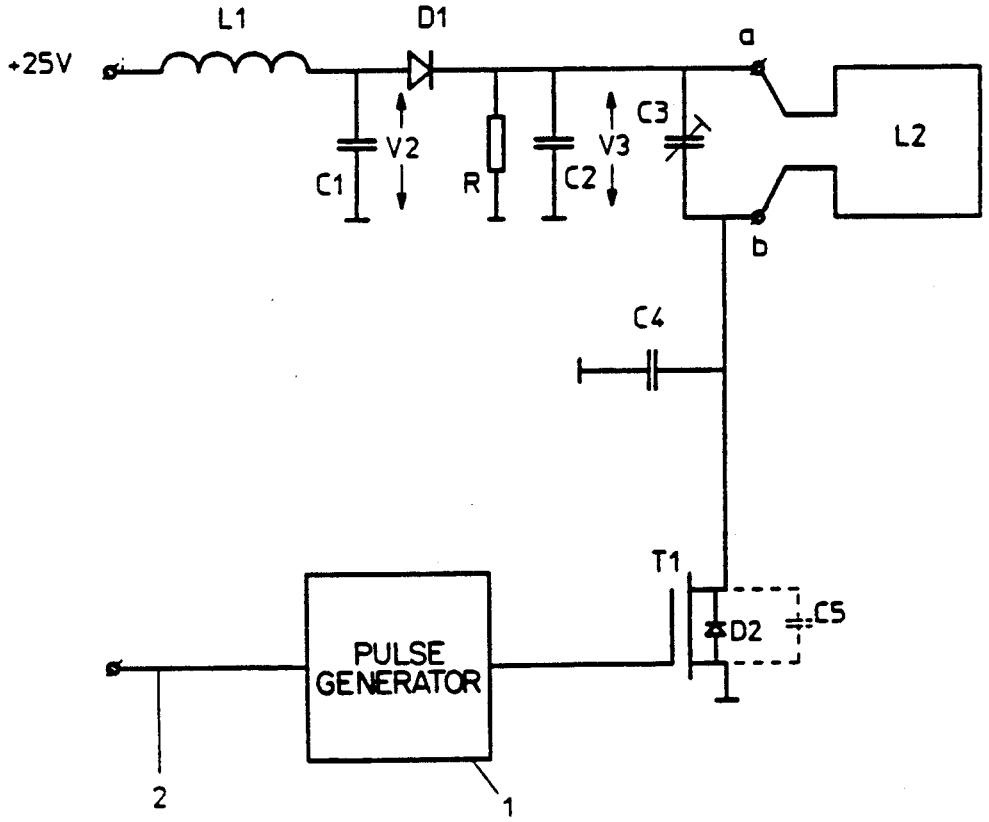
FIG. 1 is a circuit diagram of one example of a deactivator according to the invention.

FIG. 1 shows a schematic diagram of a deactivator according to the invention. Its operation is as follows. An antenna coil L2, which may for instance consist of a single wire frame, is at one end connected to a supply source via a diode D1 and a coil L1, which supply source provides a supply voltage of about 25 V, for instance. At the other end, the coil L2 is connected to a transistor T1, here functioning as a switch. The coil L2 forms an electric resonance circuit with capacitors C2, C3, C4 and C5. The end of the coil L1 that is connected to the diode D1 is grounded via a capacitor C1. The capacitor C5 can be formed by the parasitic capacity of the transistor T1. When a deactivation operation is initiated, in the embodiment shown, at input 2 of a pulse generator 1 a control signal is applied in the form of a symmetrical square wave voltage of a frequency of 10 Hz, of a length of ten periods. The pulse generator 1 generates therefrom a pulse train of ten pulses, each of a length of 2 μs. With these pulses, the transistor T1 is each time rendered conductive momentarily.

In the following, the operation as a result of one pulse is considered. As a result of a pulse of a duration of 2 μs, the transistor T1 is conductive for a period of 2 μs. Then, a current I will flow from the supply to mass via the coil L1, the diode D1 and the coil L2. The current is limited by the self-inductions of coils L1 and L2, so that df/dt is about $5.10^6$ A/s. At the moment when the pulse has ended and, accordingly, T1 is going to block again, a current of about 10 A flows through the coil L1 and through the coil L2. As a consequence thereof, at that moment an amount of energy of about $60.10^{-6}$ J is stored in the magnetic field of the coil L2. When transistor T1 begins to block, the current will want to continue flowing as a result of the self-induction of the coil L2, but the current I can only flow to the capacitors C4 and C5. The voltage at the point of connection b of the coil L2 between the capacitors C3 and C4 will rise during a first quarter period until the energy from coil L2 has transferred completely to capacitors C3, C4, and C5. The voltage at the other point of connection a of the coil L2, which tends to become negative, is maintained, via diode D1, approximately at the value of the voltage across capacitor C1.

Figure 2A:
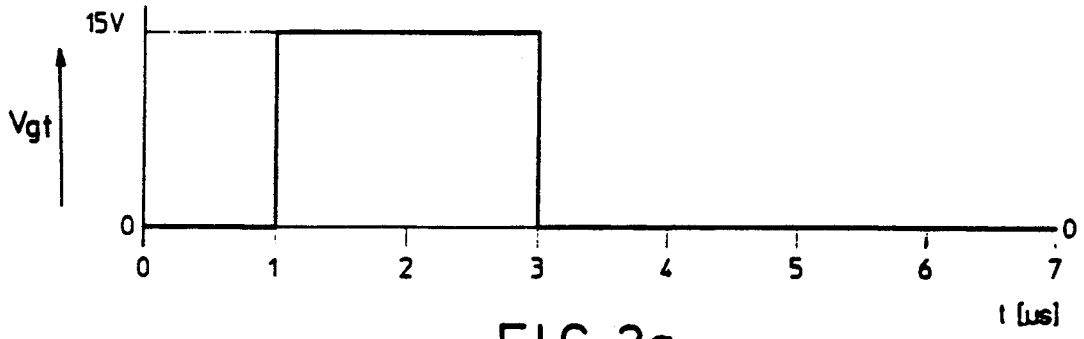
Figure 2B:
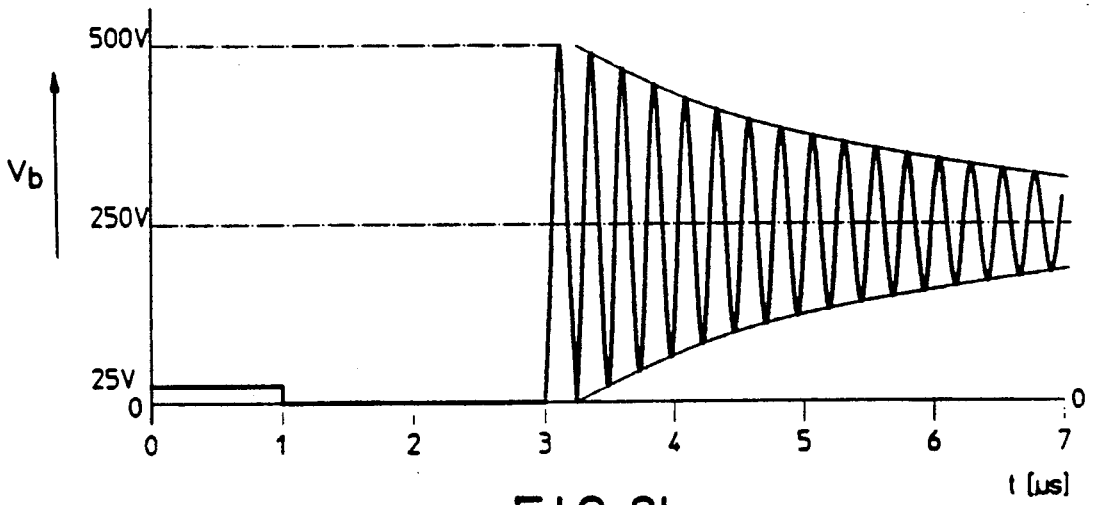
Figure 2C:
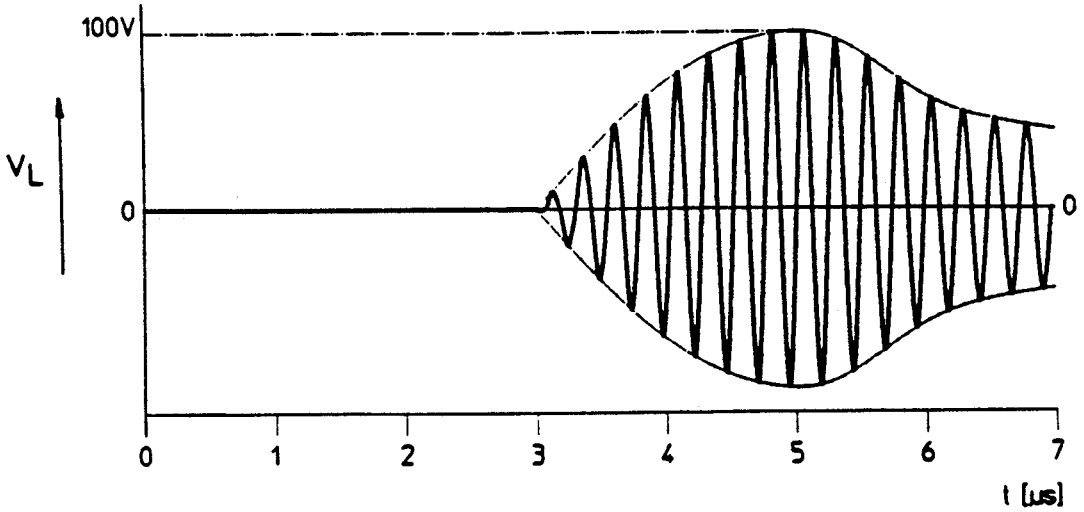

FIG. 2*a* shows the voltage Vgt of the gate of transistor T1, and FIG. 2*b* shows the course of the voltage Vb of point of connection b. FIG. 2*c* shows the voltage VL generated across the capacitor in a label to be deactivated. After the current through the coil L2 has become zero, this current will start to flow in reverse direction as a result of the voltage of capacitors C4 and C5. The capacitors C4 and C5 are thereby discharged and the voltage across capacitor C2 rises. After the second quarter period, the voltage between point a and point b is zero and the current through the coil L2 is maximal. Thereafter, this current will continue to flow as a result of the self-induction of the coil L2 and cause the voltage across the capacitor C2 to rise further, while the voltage across the capacitors C4 and C5 decreases further. At some time, the voltage across the capacitors C4 and C5 will be zero and subsequently be negative momentarily. The diode D2, which is integrated into the transistor T1, will then enter the conductive state. The voltage across the capacitors C4 and C5 cannot now become more negative and the current through the coil L2 will subsequently flow through the diode D2 and to earth via the capacitor C2, until the current has become zero and the capacitor C2 has been charged to a maximum. In the last quarter period, capacitor C2 is discharged again across L2, the capacitors C4 and C5 thereby being charged positively again until the current I has reached the maximum value again. Thereafter, a new cycle begins. Capacitor C3 is an adjustable capacitor of a relatively minor capacity value, intended for fine-adjusting the resonant frequency of the antenna circuit. This capacitor plays a minor role in the energy transfer. Owing to limited bandwidth of the resonant circuit in the label, it takes a number of periods for the oscillation of the voltage across the capacitor of the label to reach a maximum, as can be seen in FIG. 2*c*. It is therefore important that the alternating current, which may for instance have a frequency of 8 MHz, through antenna coil L2 is at a maximum for a plurality of periods. This is provided for by the circuit L1-C1 D1. After switching off of the current through the transistor T1, the voltage across the capacitor C1 rises owing to the transfer of energy in the field of the coil L1 to the capacitor C1. The coil L1 and the capacitor C1, however, are so dimensioned that the resonant frequency of the circuit L1, C1 is for instance 1 MHz, i.e. in this example a factor 8 lower than that of the circuit L2, C4. The rise of the voltage across the capacitor C1, therefore, occurs more slowly than the rise of the voltage across the capacitor C4 and is at a maximum only after two full periods of the oscillation across the coil L2. The amount of magnetic energy stored in the coil L1 at the moment when the current I is switched off, is approx. $235.10^{-6}$ J. This is significantly more than is stored in the antenna coil L2. This energy is converted into electrical energy which is stored in the capacitor C1 in the first 250 ns following the switching off of transistor T1. In this time interval, two complete oscillations occur in the antenna circuit with the coil L2. At the moments when the voltage across the capacitor C2 is lower than the voltage across the capacitor C1, charge will flow from the capacitor C1 to the capacitor C2 via diode D1. A part of the energy stored in the circuit L1 C1, therefore, transfers to the antenna circuit C2-L2-C4-C5. The result is that in the first three periods of the oscillation in the antenna circuit energy is supplemented from the circuit L1-C1.

Figure 3:
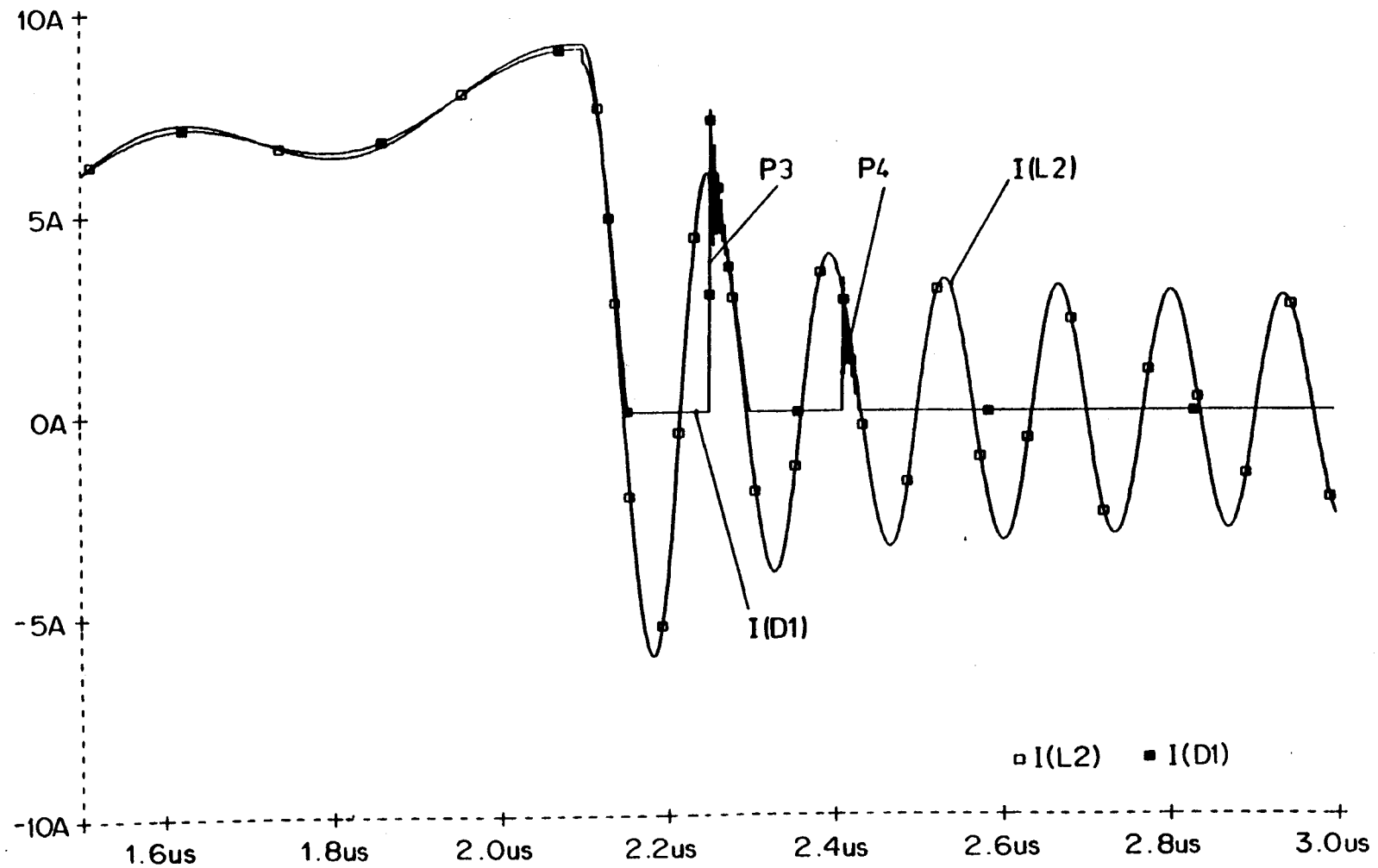
Figure 4:
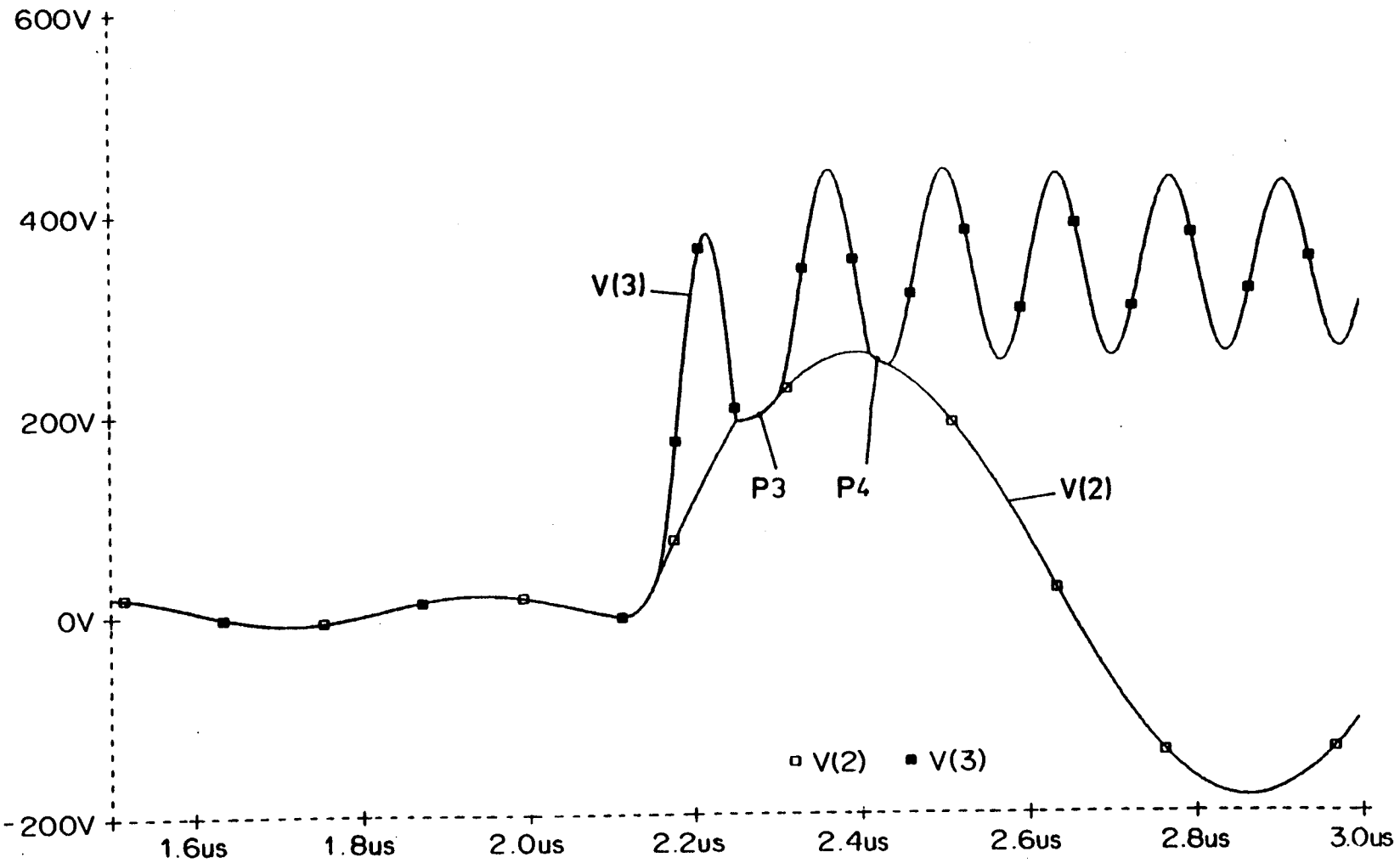

FIG. 3 illustrates the curve of the current I(L2) through the antenna coil and of the current I(D1) through the diode D1. It shows that in the two periods after the first period, the current through D1 contributes to the current through L2 in the form of two pulses P3 and P4. FIG. 4, too, shows this effect with reference to the voltage V(2) across C1 and the voltage V(3) across C2. At the point where V(3) threatens to fall below V(2), the diode D1 is going to conduct and a part of the current through L1 flows not to capacitor C1 but to capacitor C2 via diode D1. In the curve of the voltage V(2) across the capacitor C1, this effect can be observed from the dents that arise where in FIG. 4 the voltage V(3) equals the voltage V(2). These moments correspond to the moments when the current pulses through the diode D1 occur and have accordingly been indicated likewise by the designations P3 and P4. The result of this energy transfer from the circuit L1-C1 to the antenna circuit is that from the moment when T1 is switched off for some periods a maximum amount of energy is available in the form of a magnetic alternating field coming from antenna coil L2. In the resonant circuit of an adhesive label that is disposed in the field, sufficient induction voltage can thus be built up to effect the breakdown of the capacitor of the resonant circuit of the label and thereby to deactivate the label. Because the total energy that is available for the deactivation operation in the coil L1 and the coil L2, on account of the resonance of circuit C2-L2-C3-C4-C5 through the antenna coil L2, is converted into an alternating field with a spectral energy distribution which is closely centered around the resonant frequency of the adhesive labels, this energy is effectively used. The result thereof is that only little power needs to be provided from the dc voltage supply, so that coupling to an existing packaging table detector does not have any consequences for the supply. Further, as a result of the concentration of the energy within a very limited frequency range, the disturbing radiation will also be limited to that frequency range.

Figure 5:
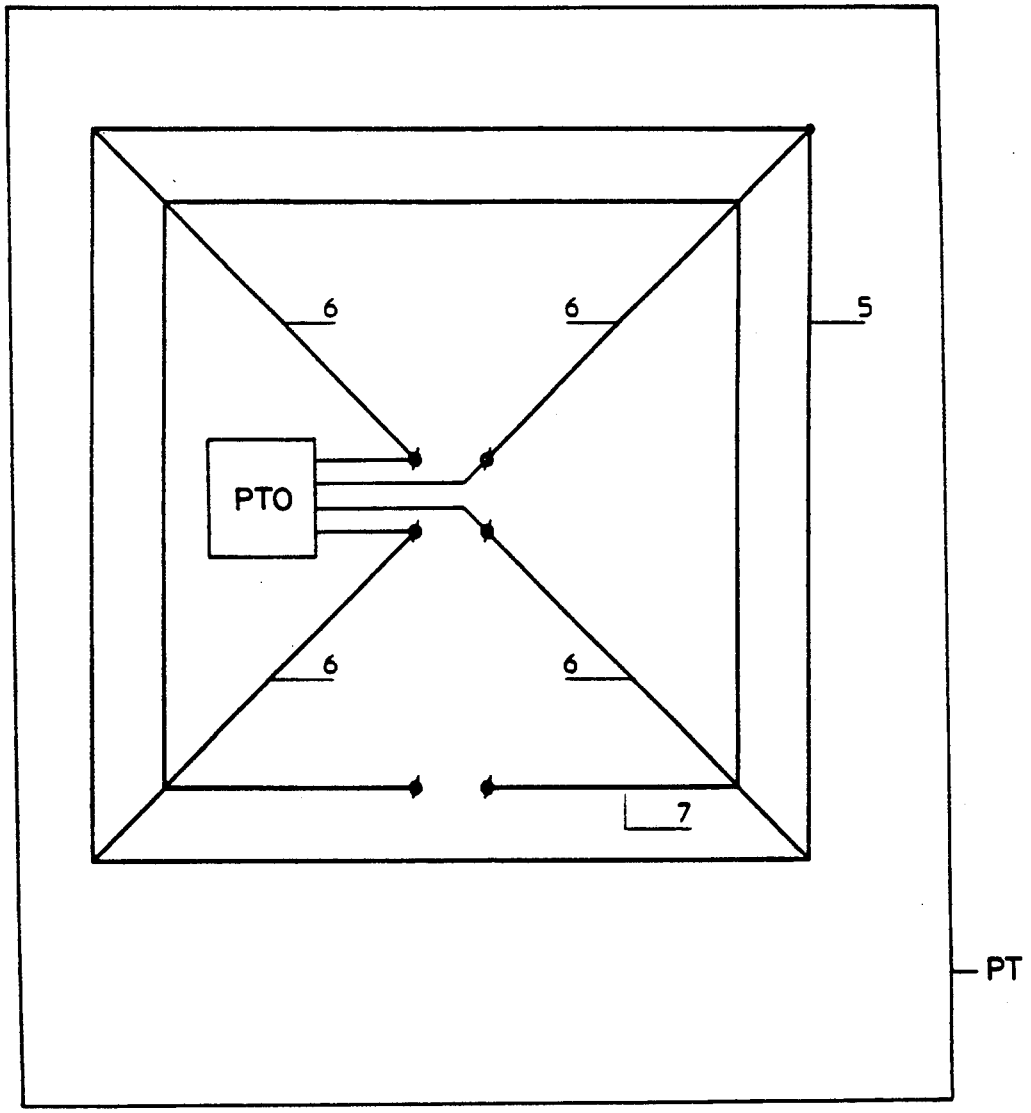
FIG. 5 shows an example of a combined packaging table and deactivator antenna.

The antenna coil L2 is preferably integrated into the antenna of a packaging table detector. In applicant's patent application EP-A-0371562, which is incorporated herein by reference, a square antenna intended for use in a packaging table detector is described. This known square antenna with two diagonal connections forms a double 8-shaped loop, intended for simultaneous use at two different frequencies. By giving the antenna coil L2 likewise the shape of a square and arranging it concentrically in the plane of the packaging table detector antenna, the coil L2 has no coupling with the 8-shaped loops of this packaging table detector antenna. As a consequence, the addition of the deactivation function does not disturb the proper operation of the packaging table detector antenna. Reference is made to FIG. 5 in which antenna loop 5, together with the diagonal branches 6, forms an antenna of a packaging table detector (not shown). The antenna coil L2 of the deactivator is indicated at 7. The antenna coil L2, however, is tuned to the resonant frequency of the labels and even a very weak residual coupling between the antenna coil L2 and the packaging table detector antenna could cause a spurious label pulse in the packaging table detector when the deactivator is in operation. The present invention further provides a solution to the problem outlined above. Transistor T1, which may advantageously be of the high-power MOSFET type, has a large internal parasitic capacity between source and drain, indicated in FIG. 1 by capacitor C5. The magnitude of this capacity to a great extent depends on the voltage across this capacitor. At rest, i.e. when the packaging table detector is operative, T1 is blocked, so that the voltage across capacitor C5 is equal to the supply voltage, i.e. 25 V in this example. The capacity of capacitor C5 is large then, so that the circuit C2-L2-C4-C5 is tuned to a low frequency. When the deactivator is started, first, transistor T1 becomes conductive for 2 μs, whereby the voltage across capacitor C5 becomes zero and after transistor T1 blocks again, the voltage across C5 oscillates up to approx. 500 V, so that during the deactivating operation the average voltage across C5 is 250 V. The capacity of capacitor C5 is then much smaller, so that the resonant frequency becomes higher. The circuit C2-L2-C3-C4-C5 is now dimensioned in accordance with the invention in such a manner that during the deactivating operation this circuit is tuned to the resonant frequency of the labels and that during the rest periods, when the packaging table detector must function, this resonant frequency is lower, i.e. falls outside the operating range of the packaging table detector. Thus, the operation of the deactivator does not lead to a spurious label pulse.

It is observed that after the foregoing, various modifications will readily occur to anyone skilled in the art. Thus, if a type of transistor is used that does not have a voltage-dependent parasitic capacity, an external capacitor with a voltage dependent capacity value could be used. Such modifications are understood to fall within the framework of the invention.

We claim:

1. A deactivating device for deactivating shoplifting detection labels of an electronic shoplifting detection system, which labels comprise a resonant circuit with a coil and a capacitor, said deactivating device comprising an antenna circuit comprising an antenna coil tuned with at least one capacitor to the resonant frequency of the resonant circuit, by means of which sufficient energy can be induced in a resonant circuit of a label to effect electrical breakdown in the capacitor thereof, wherein the antenna coil of the deactivating device is coupled between a supply source and earth via a switching means having a conductive state and a blocking state; and control means for supplying at intervals control pulses to the switching means in order to bring the switching means into the conductive state; wherein the energy necessary for deactivation is stored as magnetic energy in the antenna coil and the duration of each control pulse is chosen such that at the end of a control pulse, when the switching means returns to the blocking state, the energy necessary for deactivation has accumulated as magnetic energy in the antenna coil, which energy is subsequently converted into an alternating electromagnetic field for application to a detection label when the switching means is in the blocking state.

2. A deactivating device according to claim 1, wherein the deactivating device comprises an auxiliary coil and an auxiliary capacitor, in which auxiliary energy is stored after the switching means has been brought into the conductive state, said auxiliary coil and capacitor supplying energy to the antenna circuit shortly after the energy conversion to the alternating electromagnetic field.

3. A deactivating device according to claim 2, wherein the auxiliary coil is connected between the supply source and one terminal of the auxiliary capacitor, whose other terminal is connected to earth, while a junction between the auxiliary coil and the auxiliary capacitor is connected to the anode of a diode, whose cathode is coupled with the antenna circuit.

4. A deactivating device according to claim 3, wherein the auxiliary coil and the auxiliary capacitor together have a resonant frequency which is considerably lower than that of the antenna circuit.

5. A deactivating device according to claim 1, wherein the auxiliary coil and the auxiliary capacitor together have a resonant frequency which is considerably lower than that of the antenna circuit.

6. A deactivating device according to claim 1, wherein connected parallel with the switching means is at least one further capacitor, and a diode connected in reverse bias.

7. A deactivating device according to claim 6, wherein said at least one further capacitor is a voltage-dependent capacitor.

8. A deactivating device according to claim 7, wherein the voltage-dependent capacitor is so dimensioned that the resonant frequency of the antenna circuit during application of the alternating electromagnetic field to a detection label substantially corresponds to the resonant frequency of the resonant circuit of the shoplifting detection labels, while the resonant frequency of the antenna circuit in a state of no disturbance deviates considerably from the resonant frequency of the resonant circuit of the shoplifting detection labels.

9. A deactivating device according to claim 8, wherein said voltage dependent capacitor is formed at least partly by the internal parasitic capacity of the switching means.

10. A deactivating device according to claim 9, wherein the parasitic capacity is a voltage-dependent capacity.

11. A deactivating device according to claim 8, wherein the switching means is a power transistor of the MOSFET type.

12. A deactivating device according to claim 6, wherein said at least one further capacitor is formed at least partly by the internal parasitic capacity of the switching means.

13. A deactivating device according to claim 12, wherein the parasitic capacity is a voltage-dependent capacity.

14. A deactivating device according to claim 13, wherein the switching means is a power transistor of the MOSFET type.

15. A deactivating device according to claim 1, wherein the antenna coil is arranged concentrically relative to an antenna coil of a packaging table detector of an electromagnetic shoplifting detection system.

16. A deactivating device for deactivating shoplifting detection labels of an electronic shoplifting detection system, which labels comprise a resonant circuit with a coil and a capacitor, said deactivating device comprising an antenna circuit comprising an antenna coil tuned with at least one capacitor to the resonant frequency of the resonant circuit, by means of which sufficient energy can be induced in a resonant circuit of a label to effect electrical breakdown in the capacitor thereof, wherein the antenna coil of the deactivating device is coupled between a supply source and earth via a switching means having a conductive state and a blocking state; and control means for supplying at intervals control pulses to the switching means in order to bring the switching means into the conductive state; wherein the energy necessary for deactivation is stored as magnetic energy in the antenna coil, and the duration of each control pulse is chosen such that at the end of a control pulse, when the switching means returns to the blocking state, the energy necessary for deactivation has accumulated as magnetic energy in the antenna coil, which energy is subsequently converted into an alternating electromagnetic field when the switching means is in the blocking state; wherein the deactivating device comprises an auxiliary coil and an auxiliary capacitor, in which auxiliary energy is stored after the switching means has been brought into the conductive state, the auxiliary coil and capacitor supplying energy to the antenna circuit shortly after the energy conversion to the alternating electromagnetic field; and wherein connected parallel with the switching means is at least one further capacitor, which at least one further capacitor is a voltage-dependent capacitor.

17. A deactivating device according to claim 16, wherein said at least one further capacitor is at least partly formed by the internal parasitic capacity of the switching means.

18. A deactivating device according to claim 17, wherein the switching means is a power transistor of the MOSFET type.

19. A deactivating device according to claim 16, wherein the voltage-dependent capacitor is so dimensioned that the resonant frequency of the antenna circuit during the alternating electromagnetic field of a deactivating operation substantially corresponds to the resonant frequency of the resonant circuit of the shoplifting detection labels, while the resonant frequency of the antenna circuit in a state of no disturbance deviates considerably from the resonant frequency of the resonant circuit of the shoplifting detection labels.

20. A deactivating device according to claim 18, wherein said voltage dependent capacitor is at least partly formed by the internal parasitic capacity of the switching means.

21. A deactivating device according to claim 20, wherein the switching means is a power transistor of the MOSFET type.

22. A packagaing table for a shoplifting detecting system, which packaging table comprises a packaging table detector with a substantially rectangular antenna loop with branches extending diagonally, wherein a second substantially rectangular antenna loop which is of a shape similar to the first substantially rectangular antenna loop and arranged concentrically relative thereto is provided, which second antenna loop is part of a deactivating device for shoplift-detection labels.

* * * * *